US005754087A

United States Patent [19]

Goseberg

[11] Patent Number: 5,754,087

[45] Date of Patent: May 19, 1998

[54] HIGH-VOLTAGE TRANSFORMER FOR A TELEVISION RECEIVER

[75] Inventor: Walter Goseberg, Hanover, Germany

[73] Assignee: Deutsche Thomson Brandt GmbH, Villigen-Schwenningen, Germany

[21] Appl. No.: 622,915

[22] Filed: Mar. 27, 1996

[30] Foreign Application Priority Data

Apr. 28, 1995 [DE] Germany ..... 195 15 226.3

[51] Int. Cl.[6] ..... H01F 21/08; H01F 27/28

[52] U.S. Cl. ..... 336/178; 336/165

[58] Field of Search ..... 336/165, 178

[56] References Cited

U.S. PATENT DOCUMENTS 4,728,918 3/1988 Neusser et al. ..... 336/83

FOREIGN PATENT DOCUMENTS 4302271 8/1994 Germany .

*Primary Examiner*—J. R. Scott

*Assistant Examiner*—Anh Mai

*Attorney, Agent, or Firm*—Joseph S. Tripoli; Frederick A. Wein

[57] ABSTRACT

A high-voltage transformer for a television display device having a core made of two core parts. One end of a core limb is chamfered or rounded on the outside such that the contact region is distal from the outer edge of the core limb. The end of the core limb is preferably provided with a bevel.

6 Claims, 1 Drawing Sheet

HIGH-VOLTAGE TRANSFORMER FOR A TELEVISION RECEIVER

BACKGROUND

The invention is based on a high-voltage transformer.

The tilting of the two core halves with respect to one another produces a wedge-shaped air gap between the ends of abutting core limbs, which air gap advantageously influences the magnetization characteristic of the transformer. The two limbs in this case abut, for example, on the outer edge of the core. At the same time, the contact area is in the form of a point or line and is thus very small. This small area results in a high contact pressure. Discrepancies, caused by tolerances, in the geometric position of the two core limbs with respect to one another and in the dimensions of the core limbs can thus result in the outer edges of the two core limbs corresponding precisely, and the risk of an edge breaking off on the outside of one core limb is then particularly high.

SUMMARY OF THE INVENTION

The invention is based on the object of modifying the core such that, even in the event of tolerances, the two core limbs make correct contact and the risk of core parts breaking off is reduced.

Thus, according to the invention, the end of one core limb is chamfered or rounded on the outside such that the contact region between the core limbs is away from the outer edges of the core limbs. This design of a core limb results, essentially, in two advantages.

As a result of the chamfering or rounding, the contact region in which the two ends of the two limbs abut is displaced from the outer edge of the core limbs in the direction of the centre of the core limbs. If tolerances now occur in the position of this region, then there is no longer any risk of the contact region corresponding with the edges of the core limbs. The contact region, which is in the form of a point or line, in particular, is thus reliably always located for a core in a region of the end of the core limb which is far enough away from the edge. The risk of this core fracturing is thus eliminated. The following statement applies to the other core half:

In the case of the known solution, the edge of the one core limb by means of which said core limb is in contact with the end of the other core limb forms an angle of 90° and is thus relatively sharp. In the case of the chamfering or rounding according to the invention, the edge at the end of the one core limb which abuts against the end of the other core limb forms an increased angle in the order of magnitude of 130°–150° and is thus less sharp, as a result of which the risk of damage to this core limb is reduced. The invention can be used in the case of core limbs having a round cross-section and having a rectangular cross-section.

The end of the core limb is preferably provided with a bevel. Such a bevel can be produced during stamping of the core, without any significant additional cost.

The bevel preferably forms an angle in the order of magnitude of 130° with the end of the core limb and extends, for example, over approximately 10% of the width or of the diameter of the core limb.

The core limb is preferably chamfered or rounded symmetrically in the same manner on opposite edges. In consequence, production can be simplified and, in particular, stresses can be avoided during sintering of the core.

BRIEF DESCRIPTION OF THE DRAWINGS

The invention is explained in the following text with reference to the drawing, in which.

DESCRIPTION OF THE PREFERRED EMBODIMENT(S)

Figure 1:
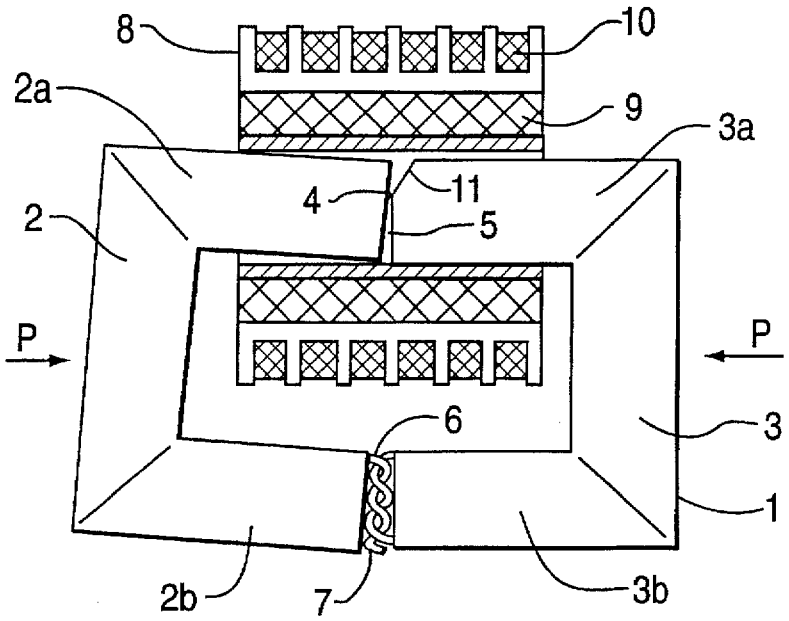
FIG. 1 shows a high-voltage transformer for a television receiver having a core designed according to the invention.

FIG. 1 shows a ferrite core 1 having two U-shaped core halves 2, 3 whose parallel limbs 2*a*, 2*b* and 3*a*, 3*b* respectively are joined together. In this case, a first abutment point is produced between the core limbs 2*a* and 3*a* and a second abutment point between the core limbs 2*b* and 3*b*. The two core halves 2, 3 are tilted with respect to one another. This results in a wedge-shaped air gap 5 at the upper abutment point, which air gap produces the described improvement in the magnetization characteristic of the transformer and the reduction in the internal impedance of the high-voltage source. The core limbs 2*a* and 3*a* are fitted with the coil former 8, which is fitted with the primary winding 9 and the high-voltage winding 10, which is designed as a chamber winding.

A larger wedge-shaped air gap 6 is produced at the second abutment point between the core limbs 2*b* and 3*b*. A twisted, uninsulated copper wire is inserted into this air gap. As is indicated by the arrows P, the two core halves 2, 3 are pressed together after the coil former 8 is fitted, as a result of which the twisted copper wire 7 deforms. During this process of pressing the core halves 2, 3 together, the inductance of the primary winding 9 is at the same time measured, this inductance increasing as the core halves 2, 3 are pressed together, as a result of the reduction in the width of the air gap 6 (and thus the magnetic reluctance). When the desired inductance is reached, the process of pressing the core halves together is ended, and the core is locked in this position by bonding, by a surrounding bracket or by the coil former 8 itself. If the ends of the limbs 2*a* and 3*a* were identical and round, then only one point would result for the contact point, with the corresponding high pressure and the risk of ferrite breaking off.

The end of the core limb 3*a* is now provided with a chamfer in the form of a bevel 11, which forms an angle $\alpha$ of approximately 130° with the other surface region of the end of the core limb 3*a*. As a result of this bevel 11, the abutment point 4, which would intrinsically be located on the upper edge of the core limbs 2*a* and 3*a*, is shifted in the direction of the centre of the core limbs 2*a*, 3*a*. The abutment point 4 is now so far away from the edge of the core limbs 2*a* and 3*a* that the edge at the end of the core limb 3*a* rests on the end surface of the core limb 2*a* such that it is far more susceptible to fracture.

Figure 2:
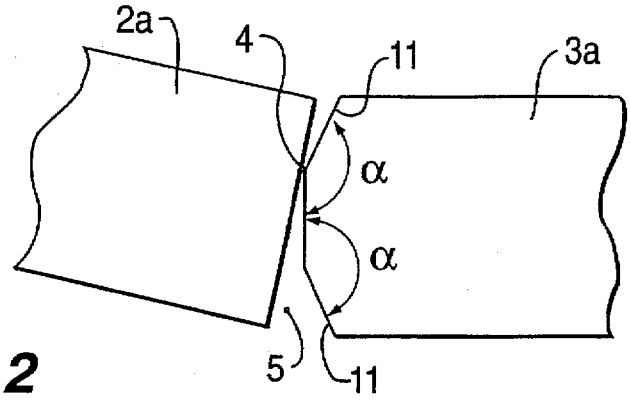
FIG. 2 shows the abutting core limbs in an enlarged illustration.

FIG. 2 shows the design of the core limbs 2*a* and 3*a*, somewhat enlarged. It can be seen that the angle $\alpha$ between the bevel 11 and the other end of the core limb 3*a* is considerably larger than 90°, namely approximately 130°–150°. This increased angle reduces the risk of destruction of the core or of individual core parts breaking off. For production-engineering reasons, the bevel 11 is also provided symmetrically on the other edge of the core limb 3*a*.

Figure 3:
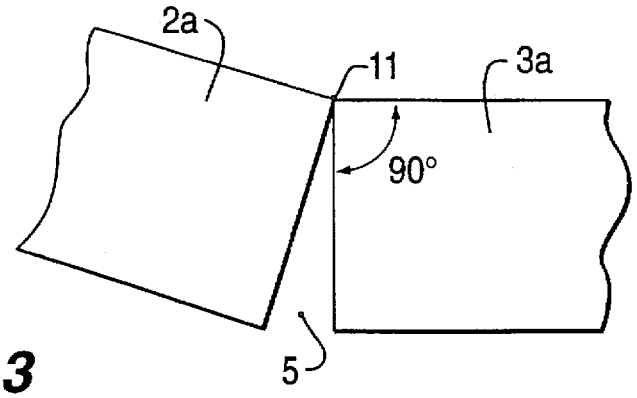
FIG. 3 shows a known core design.

FIG. 3 shows a known arrangement of the mutually tilted core limbs 2*a*, 3*a*. This results in the hazardous contact 11, in the form of a point or line, between two sharp edges, in the case of which the risk of ferrite parts breaking off is very high.

I claim:

1. High-voltage transformer for a television display device comprising:

a core made of two U-shaped core parts which are tilted with respect to one another in such a manner that ends of two core limbs form a wedge-shaped air gap and abut on an outside in a contact region, the end of one core limb being chamfered or rounded on the outside such that a contact region is distal from an outer edge of the other core limb.

2. Transformer according to claim 1, wherein the end of the core limb is provided with a bevel.

3. Transformer according to claim 2, wherein the bevel forms an angle of about 130° with the end of the core limb.

4. Transformer according to claim 2, wherein the bevel extends over approximately ten percent of the diameter of the core limb.

5. Transformer according to claim 1, wherein the core limb is chamfered or rounded symmetrically in the same manner on opposite edges.

6. The transformer according to claim 1 wherein between two other core limbs, a twisted copper wire is disposed for adjusting the inductance of the transformer.

* * * * *